US012173570B2

(12) United States Patent
Manttari et al.

(10) Patent No.: US 12,173,570 B2
(45) Date of Patent: Dec. 24, 2024

(54) INLET TUBE, ROCK DRILLING RIG AND METHOD OF SAMPLING

(71) Applicant: SANDVIK MINING AND CONSTRUCTION OY, Tampere (FI)

(72) Inventors: Maunu Manttari, Tampere (FI); Pekka Koivukunnas, Turku (FI); Lasse Tuominen, Oulunsalo (FI); Rami Raute, Turku (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 18/216,268

(22) Filed: Jun. 29, 2023

(65) Prior Publication Data

US 2024/0003207 A1 Jan. 4, 2024

(51) Int. Cl.

| | |
|---|---|
| ***E21B 21/07*** | (2006.01) |
| ***E21B 21/015*** | (2006.01) |
| ***E21B 49/08*** | (2006.01) |

(52) U.S. Cl.

CPC ..... *E21B 21/07* (2013.01); *E21B 21/015* (2013.01); *E21B 49/086* (2013.01)

(58) Field of Classification Search

CPC ..... E21B 21/01; E21B 21/015; E21B 21/07; E21B 49/005; E21B 49/02; E21C 35/223; G01N 1/10; G01N 1/14; G01N 1/38; G01N 2001/1006; G01N 2001/1445; G01N 2001/1454; B01F 25/4311; B01F 25/4331; B01F 25/431971; B01F 27/054; B01F 27/06

See application file for complete search history.

(56) References Cited

U.S. PATENT DOCUMENTS

| | | | | | |
|---|---|---|---|---|---|
| 1,981,570 | A | * | 11/1934 | Price | E21B 21/015 173/60 |
| 2,930,967 | A | * | 3/1960 | Laird | E21B 49/005 204/411 |
| 3,045,769 | A | * | 7/1962 | Feucht | E21B 21/015 175/220 |
| 3,460,858 | A | * | 8/1969 | Wolters | E21B 17/04 285/190 |
| 3,916,634 | A | * | 11/1975 | Woodruff | E21B 21/01 175/205 |
| 3,924,696 | A | | 12/1975 | Horlin et al. | |
| 4,164,960 | A | * | 8/1979 | Howard | B01F 25/31 137/897 |
| 4,332,301 | A | * | 6/1982 | Jonell | B01D 50/20 73/863.25 |

(Continued)

FOREIGN PATENT DOCUMENTS

| | | | | |
|---|---|---|---|---|
| AU | 743936 B2 | | 2/2002 | |
| CN | 201852466 U | * | 6/2011 | B01F 3/02 |

(Continued)

*Primary Examiner* — Jennifer H Gay
(74) *Attorney, Agent, or Firm* — Corinne R. Gorski

(57) ABSTRACT

An inlet tube of a sampling device, a rock drilling rig, and a method for taking samples is provided. The inlet tube is mountable to a dust collecting system of a rock drilling rig and is provided with at least one actively controllable homogenizing element forming a physical element for generating disturbance in flow and to thereby homogenize particle distribution of the drilling cuttings in the flow.

7 Claims, 4 Drawing Sheets

(56) References Cited

U.S. PATENT DOCUMENTS

| | | | | |
|---|---|---|---|---|
| 4,974,452 | A | 12/1990 | Hunt et al. | |
| 7,987,929 | B2 * | 8/2011 | Sormunen | B01D 46/71 175/206 |
| 10,018,037 | B2 * | 7/2018 | Lindfors | E21B 21/01 |
| 10,416,015 | B2 * | 9/2019 | Xie | G01F 1/74 |
| 10,464,038 | B2 * | 11/2019 | Jang | B01F 25/4331 |
| 10,677,627 | B2 * | 6/2020 | Xie | G01N 1/38 |
| 11,053,794 | B2 * | 7/2021 | Lindfors | E02D 1/08 |
| 2007/0177452 | A1 * | 8/2007 | Aroussi | F23K 3/02 138/40 |
| 2010/0320000 | A1 * | 12/2010 | Sormunen | B01D 46/71 95/273 |
| 2017/0120214 | A1 * | 5/2017 | Jang | B01F 25/103 |
| 2018/0010944 | A1 * | 1/2018 | Xie | G01N 1/38 |
| 2019/0226338 | A1 * | 7/2019 | Lindfors | E02D 1/02 |
| 2020/0284765 | A1 * | 9/2020 | Rustad | E21B 47/01 |
| 2024/0003206 | A1 * | 1/2024 | Manttari | E21B 21/015 |
| 2024/0003207 | A1 * | 1/2024 | Manttari | E21B 21/011 |

FOREIGN PATENT DOCUMENTS

| | | | | | |
|---|---|---|---|---|---|
| CN | 113230916 | A | * | 8/2021 | B01F 13/1047 |
| CN | 115582038 | A | * | 1/2023 | |
| CN | 218189337 | U | * | 1/2023 | |
| DE | 3634149 | A1 | * | 5/1987 | B25D 17/11 |
| EP | 286789 | A1 | | 2/2002 | |
| EP | 2447698 | A1 | * | 5/2012 | B01F 15/00207 |
| JP | S58172589 | U | | 11/1983 | |
| JP | H11247575 | A | | 9/1999 | |
| JP | 2017061822 | A | * | 3/2017 | |
| RO | 121533 | B1 | * | 10/2007 | |
| RU | 100806 | U1 | * | 12/2010 | |
| RU | 2814014 | C1 | * | 2/2024 | |
| SU | 1088782 | A1 | * | 4/1984 | B01F 25/4331 |
| SU | 1099990 | A1 | * | 6/1984 | B01F 25/4331 |
| WO | WO-2005116391 | A1 | * | 12/2005 | E21B 21/015 |
| WO | WO-2024074756 | A1 | * | 4/2024 | |

* cited by examiner

INLET TUBE, ROCK DRILLING RIG AND METHOD OF SAMPLING

RELATED APPLICATION DATA

This application claims priority under 35 U.S.C. § 119 to EP Patent Application No. 22182452.7, filed on Jul. 1, 2022, which the entirety thereof is incorporated herein by reference.

TECHNICAL FIELD

The present disclosure relates to an inlet tube of a sample taking arrangement in a rock drilling rig. The inlet tube directs flow of drilling cuttings and air to a sampling point wherein samples are taken for analyzing properties of rock being drilled.

The disclosure further relates to a rock drilling rig and to a method of taking samples of drilling cuttings during rock drilling.

BACKGROUND

In mines and at other work sites different type of rock drilling rigs are used for drilling drill holes to rock surfaces. During the drilling process drilling cuttings are flushed out of the drill hole and are conveyed away from a drill hole opening by means of a dust collecting system. There is a need to take samples from flow containing air and solid drilling cutting particles for analyzing the particles and properties of the rock surface being drilled. It has been noted that the solid particles do not distribute evenly in the system wherefore it is difficult to take good samples. Therefore, different flow homogenizers are designed for solving this problem. However, the known solutions have still shown some disadvantages.

SUMMARY

An object of the present disclosure is to provide a novel and improved inlet tube, rock drilling rig and method for taking samples during a drilling process.

An idea of the disclosed solution is that a dust collecting system of a rock drilling rig includes a sample taking arrangement for taking samples out of flow having air and drilling cuttings. The sampling is executed at a sampling point by means of a sampling device, for example. There is an inlet tube for directing the flow of drilling cuttings and air to the sampling point. An inner cross-section of the inlet tube has a homogenizing section provided with one or more homogenizing elements for forming a physical point of discontinuity wherein shape and dimensions of the inner cross-section differ locally from sections prior and after the homogenizing section. Thus, the homogenizing element generates disturbances in the flow and can homogenize particle distribution of the drilling cuttings in the flow at the section after the homogenizing section and prior to the sampling point. Further, the homogenizing element is actively controllable whereby it can selectively provide the homogenizing section with the physical point of discontinuity and the desired particle spreading.

In other words, the flow inside the inlet tube is disturbed by the physical and dynamic homogenizing element so that the solid drilling cutting particles with different sizes are spread more evenly at the section following the homogenizing section. Thus, the homogenizing element causes a sudden change in flow geometry and dimensions inside the inlet tube when needed and this way particle distribution in the flow is changed.

An advantage of the disclosed solution is that representative samples of the drilling cuttings inside the inlet tube can be taken when the particles with different size are spread more evenly inside the inlet tube. This way quality of samples can be improved and more accurate and reliable analyzing results can be achieved.

A further advantage is that the disclosed solution is relatively simple, and inexpensive. The solution is also durable, since when the homogenizing element is in its basic position and is not active, there are no protruding physical elements subjected to wearing inside the inlet tube. Further, when the homogenizing element is not under operation, there are no physical elements which would narrow cross-sectional flow area of the inlet tube at the homogenizing section. The disclosed inlet tube can also be retrofitted easily to the existing dust collecting systems.

According to an embodiment, operation of the homogenizing element can be controlled by means of a control unit. The homogenizing element may be normally inoperable and can be selectively connected to operative state. Thus, when being inoperable, there is no discontinuity inside the inlet tube and when connected operative, the discontinuity is formed. An advantage of the controllable element is that it does not cause throttling to the flow when the spreading particle effect is not needed. The control unit may activate the homogenizing element when taking samples and then return to unoperated state.

According to an embodiment, magnitude of the caused discontinuity of the homogenizing element may be controlled under control of the control unit. In other words, the shape, dimensions, or both can be varied. This way the homogenizing element can be adjusted to different flows and situations.

According to an embodiment, the controllable homogenizing element is controlled by one or more actuators, which are controlled by means of the control unit. The actuators may be pneumatic, hydraulic, or electrical. Further, the actuators may be motors, linear motors, or cylinders, for example.

According to an embodiment, the number of the homogenizing elements is one. In some cases, one single discontinuity causing element may be sufficient to cause needed particle spreading in the flow.

According to an embodiment, there may be several homogenizing elements at the homogenizing section. When several homogenizing elements are implemented, the spreading effect can be increased and there are several control possibilities for adjusting the solution to different flow situations, for example.

According to an embodiment, shape and dimensions of the homogenizing element are dependent on structure and dimensions of the inlet tube, for example, and can therefore be designed case by case. Flow control simulation and modelling programs can be utilized for determining the shapes and dimensions of the homogenizing elements.

According to an embodiment, the inlet tube includes a bend and the homogenizing section is located at the bend. In other words, the homogenizing element is located at the bend of the inlet tube. It has been noted in experiments that the effect of the homogenizing element is intensified when it is located at the bend. The use of the bend is also beneficial because there is typically a need to direct tubes and hoses of the dust collection in angular positions and especially at areas close to separators and other devices. In bends the solid particles are often moved in the flow towards an outer side of the bend, whereby the homogenizing element can compensate this undesirable phenomena caused by inertia of the particles.

According to an embodiment, the bend may be 90°, or substantially 90°. The bend may also be any bend between 45-135°.

According to an embodiment, the inlet tube may in some cases be without any bend whereby the homogenizing section and the homogenizing element are located at a straight section.

According to an embodiment, the inlet tube has a bend with an inner curve and an outer curve and wherein the at least one homogenizing element is provided on the outer curve of the bend. In other words, the particle spreading occurs at the outer curve of the bend which is the most critical point where the solid particles tend to concentrate in the flow. Directing the particles at the outer curve side has been found to be effective.

According to an embodiment, the at least one homogenizing element is located only on the outer curve side of the bend.

According to an embodiment, the homogenizing element is a selectively expandable element. In other words, there is one or more spaces arranged in connection with the inlet tube and these spaces can be charged selectively with pressure fluid flow, such as pneumatic air or hydraulic fluid.

According to an embodiment, the homogenizing element is a bellows. In this manner the homogenizing element can be activated by directing pressure fluid flow inside it and when the pressure fluid flow is discharged, the homogenizing element returns from an active mode to an idle mode.

According to an embodiment, the expandable element is an integrated part of a wall structure of the inlet tube.

According to an embodiment, the expandable element is a separate element mounted on an inner surface of a wall structure of the inlet tube.

According to an embodiment, the homogenizing element is alternatively a mechanically movable element, which can be selectively moved in transverse direction relative to direction of the flow so that it can serve as a particle spreading element for the flow. Thus, there may be a movable wall part in the inlet tube which can be moved from a basic position inwards so that it forms the mechanical discontinuity inside the inlet tube. In one further embodiment, the mechanically movable element may comprise one or more shaped pieces which can be moved by means of one or more cylinders or motors, for example.

According to an embodiment, the inlet tube is made of resilient material and comprises one or more actuators at the homogenizing section for directing external force on an outer surface side of the inlet tube for selectively causing reversible deformation for the structure of the inlet tube at the homogenizing section. The material of a wall of the inlet tube protrudes inwards providing the inlet tube with an inner bulge which serves as the mentioned homogenizing element. In other words, shape of shell or envelope of the inlet tube is reversibly deformed for producing the desired particle spreading protrusion inside the inlet tube. Thus, the inlet tube itself forms the homogenizing element and no separate elements are required. This way, the solution is simple, inexpensive, and durable.

According to an embodiment, the inlet tube is made of rubber, or a rubber-like resilient material. Then the resilient inlet tube can be pressed locally and temporarily inwards and when the pressing is released, the inlet tube resumes its original shape and dimensions.

According to an embodiment, the actuator for pressing the inlet tube may be a linear actuator, such as a pressure medium cylinder, or an electronic linear motor.

According to an embodiment, the actuator may be provided with a pushing element by means of which the force is directed to the outer surface of the inlet tube. The pushing element may be a pin longitudinal direction of which is directed towards the outer surface of the inlet tube. Then a round end of the pin is directed to the wall of inlet tube. Alternatively, the pushing element may be a pin with a round cross-sectional shape and its outer surface is transverse to the inlet tube and is pushed against the outer surface of the inlet tube forming a bulge. In these two alternatives the pins form two different kind of bulges inside the inlet tube.

According to an embodiment, the actuator has a fixed movement length, whereby the bulge formed inside the inlet tube has substantially constant shape and dimensions.

According to an embodiment, movement length and/or force generated by the actuator can be adjusted whereby the shape and dimensions of the bulge inside the inlet tube may be adjusted.

According to an embodiment, the disclosed solution relates to a rock drilling rig comprising: a movable carrier; at least one drilling boom mounted on the carrier and including a rock drilling unit provided with a rock drilling machine; a dust collecting system for removing drilling cuttings from an opening of a drilled hole, wherein the dust collecting system is provided with a suction unit, dust collecting tubing, and at least one separator for separating solid particles from flow containing air and the drilling cuttings; and at least one sampling point for taking samples of the flow. Further, the sampling point is located prior to the separator so that the flow is still unseparated at the sampling point, and there is an inlet tube with an actively controllable homogenizing element in the dust collecting system preceding the sampling point.

The inlet tube is in accordance with the features and embodiments disclosed herein. In other words, the sampling point is located before any separation measures for the flow have been executed. An advantage of this is that the flow, where from the samples are taken, includes all possible particles since nothing has been removed from the flow.

According to an embodiment, the dust collecting system has a first separator for separating coarse solid particles from the flow and a second separator for separating fine solid particles from the flow. The first separator may be located on the drilling boom, whereas the second separator may be located on the carrier. The first separator may be a cyclone. The inlet tube and the sampling point are located just before the first separator.

According to an embodiment, the disclosed solution can be implemented in different kind of drilling techniques and purposes including, for example, production drilling and exploration drilling. The solution is suitable to be used in connection with top hammer drilling, DTH drilling and rotary drilling, for example.

According to an embodiment, the disclosed solution relates to a method of sampling in a rock drilling rig, wherein the method comprises: drilling drill holes to a rock surface; collecting produced drilling cuttings from an opening of the drill holes during the drilling by means of a dust collecting system; taking samples of flow containing air and drilling cuttings at a sampling point of the dust collecting system during the drilling; and providing the dust collecting system with an inlet tube before the sampling point.

The method further comprises changing actively cross-sectional inner shape and dimensions of the inlet tube locally for spreading drilling cutting particles in the flow evenly across the inner cross-section of the inlet tube, whereby the samples are taken downstream the mentioned particle spreading. In other words, the method comprises activating controlled sudden changes in flow geometry and dimensions inside the inlet tube for the duration of the sampling process.

According to an embodiment, the method further comprises pressing transversally a reversible deform to a resilient wall structure of the inlet tube at the homogenizing section for changing cross-sectional inner shape and dimensions of the inlet tube locally by means of an inner bulge formed in response of the pressing.

According to an embodiment, the method further comprises controlling the change of the cross-sectional inner shape and dimensions of the inlet tube under control of a control unit.

The above disclosed embodiments may be combined to form suitable solutions having those of the above features that are needed.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE FIGURES

For the sake of clarity, the figures show some embodiments of the disclosed solution in a simplified manner. In the figures, like reference numerals identify like elements.

DETAILED DESCRIPTION

Figure 1:
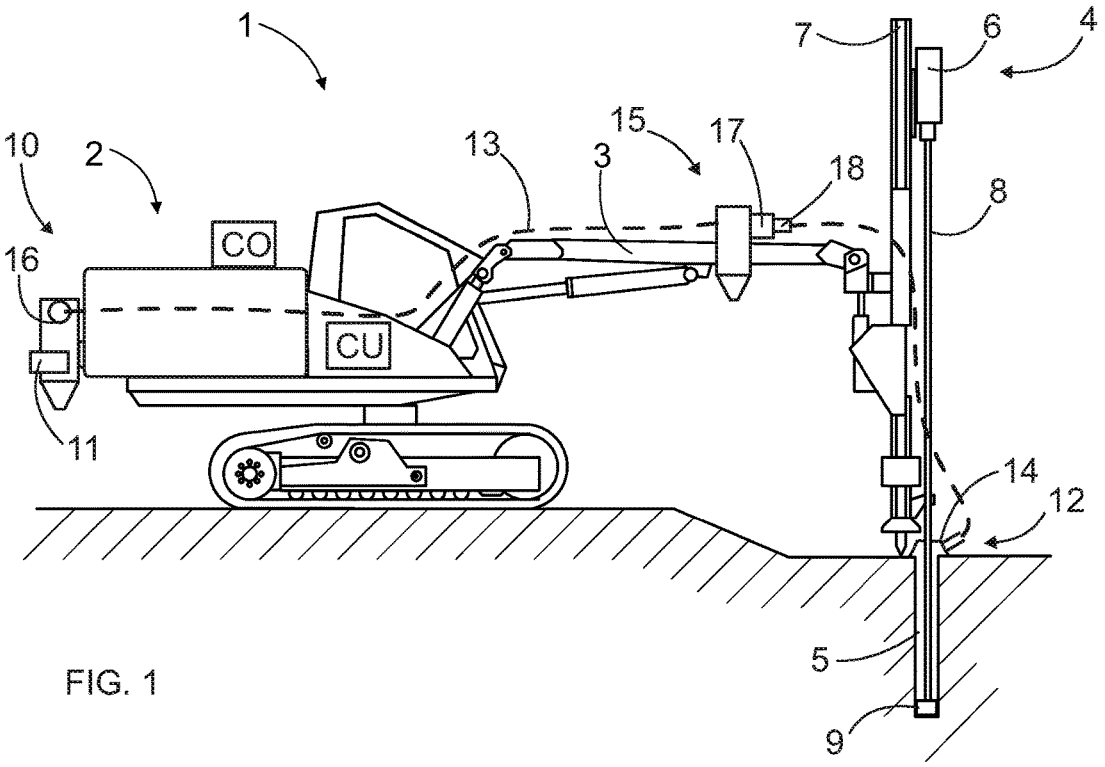
FIG. 1 is a schematic side view of a rock drilling rig for surface drilling, the rock drilling rig being provided with a dust collecting system and sampling means.

FIG. 1 discloses a rock drilling rig 1 including a movable carrier 2 and a drilling boom 3 mounted on the carrier 2. The drilling boom 3 is provided with a rock drilling unit 4 for drilling drill holes 5 to a rock surface. The rock drilling unit 4 has a rock drilling machine 6, which may be arranged movably on a feed beam 7. The rock drilling machine 6 may include an impact device and a rotating device, or alternatively it may be a rotary drilling machine and may be without any impact device.

A drilling tool 8 is connected to the rock drilling machine 6 and the drilling tool 8 may include one or more drill tubes and a drill bit 9 at its free end. During drilling rock material is broken and drilling cuttings are formed in the drill hole 5. The drilling cuttings needs to be flushed away from the drill hole 5. Typically, pressurized air is produced by means of a compressor CO and the pressurized air is directed via the drilling tool 8 to a bottom of the drill hole 5, whereby drilling cuttings are flushed away.

The drilling cuttings can be collected by a means of a dust collecting system 10 including a suction unit 11 for producing negative pressure so that the drilling cuttings can be sucked from a drill hole opening 12 via dust collecting tubes 13. There may be a suction basket 14 arrangeable on the drill hole opening 12 and being connected to the collecting tube 13. A main purpose of the dust collecting system 10 is to transfer the drilling cuttings away from the drill hole opening 12 so that visibility to the drilled target is good and no difficulties occur during the drilling process due to the large amount of the material removed from the drill hole 5.

The dust collecting system 5 may also have one or more separators for processing the collected material. There may be a first separator 15 for separating coarse particles and a second separator 16 for separating fine particles. The first separator 15 may be mounted on the drilling boom 3 and it may include a cyclone, for example. The second separator 16 may be mounted on the carrier 2 in connection with the suction unit 11, for example.

A sampling device 17 for taking samples out of flow of drilling cuttings and air in the system is arranged before the first separator 15, whereby it is located prior to any separation phase. Further, an inlet tube 18 is located before the sampling device 17. The inlet tube 18 conveys the flow to a sampling point of the sampling device 17. The inlet tube 18 includes a homogenizing element for spreading the drilling cuttings in the flow so that proper samples can be taken from the flow. Operation and structure of the homogenizing element is as it is disclosed in this document.

The rock drilling rig 1 may have one or more control units CU for controlling the operation and actuators. The control unit CU may control the sampling device 17 and the homogenizing element of the inlet tube 18, for example. Some control situations and principles are disclosed above. The control unit may include a processor for executing an input computer program product or algorithm, and it may be provided with sensing data and input control parameters.

Figure 2:
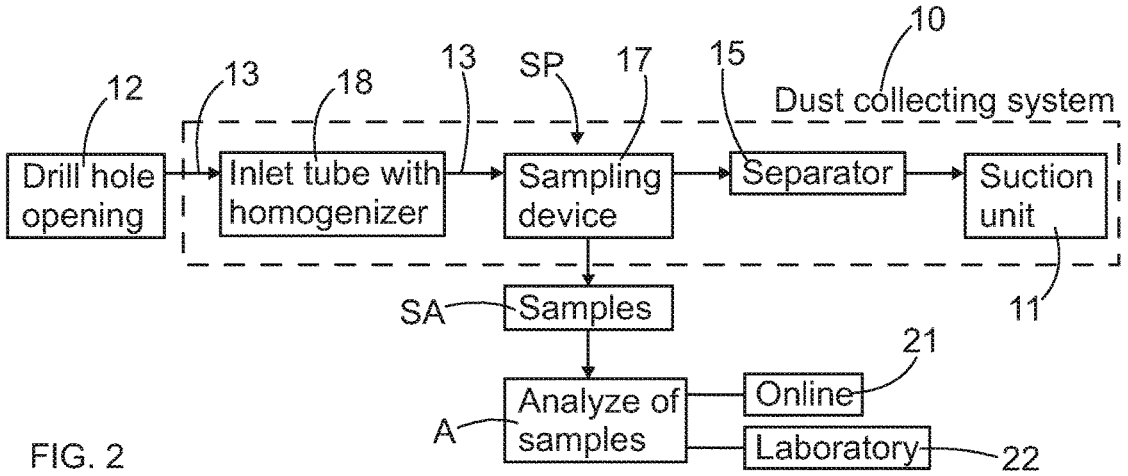
FIG. 2 is a schematic diagram showing basic elements of a dust collecting system and sampling prior executing any separation measures.

FIG. 2 discloses a dust collecting system 10 for sucking drilling cuttings from a drill hole opening 12. The system 10 includes dust collecting tubes 13 for transferring the collected flow via an inlet tube 18 to a sampling device 17 and only then to a separator 15. Thus, a sampling point SP is located between the inlet tube 18 and the separator 15. The inlet tube 18 is provided with a homogenizer for ensuring proper particle distribution in the flow. Samples SA are taken from the flow in accordance with a planned sampling schedule or procedure. The samples SA can be analyzed A either online 21 or later on in a laboratory 22.

Figure 3:
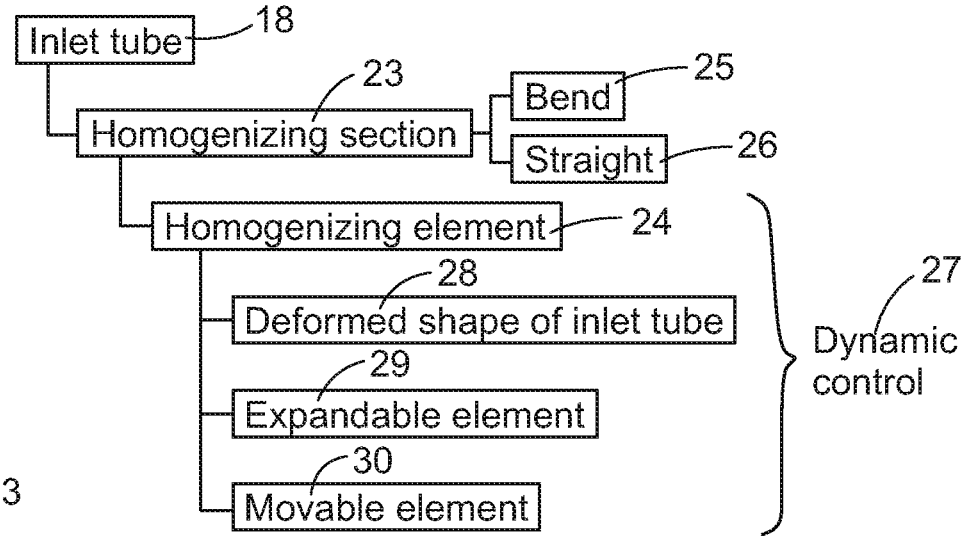
FIG. 3 is a schematic diagram showing some features of an inlet tube.

FIG. 3 discloses that an inlet tube 18 includes a homogenizing section 23, wherein an inner cross-section of the inlet tube 18 includes one or more homogenizing elements 24 forming a physical point of discontinuity, wherein shape and dimensions of the inner cross-section differ locally from sections prior and after the homogenizing section 23. The homogenizing section 23 may be located at a bend 25 or at a straight part 26 of the inlet tube 18. The homogenizing element 24 is dynamically controlled 27 and can generate disturbance in the flow when needed. The homogenizing element 24 may have different configurations. It may be based on deformation 28 of shape of the inlet tube 18. Alternatively, it may include an expandable element 29, or a movable element arranged on inner surface of the inlet tube 18.

Figure 4:
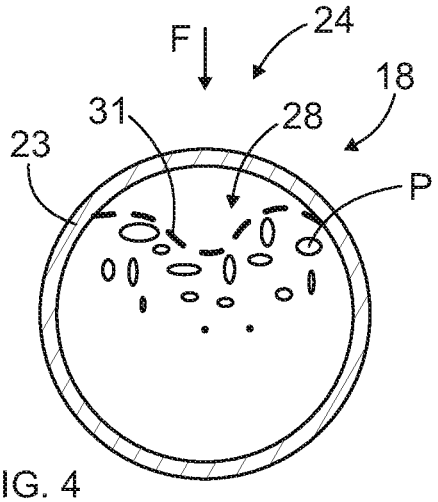
FIGS. 4 and 5 are schematic and cross-sectional views of inlet tubes and two different principles to homogenize particle distribution in passing flow.

FIG. 4 discloses that external force F can be directed towards structure of an inlet tube 18 and thereby cause inwardly protruding bulge 31 at a homogenizing section 23. The produced deformation 28 can serve as a homogenizing element. The external force F may be transmitted mechanically or by any other suitable means to cause the desired deformation on wall of the inlet tube 18. The bulge 31 or protruding deformation can direct solid particles towards a free flow passage area inside the inlet tube 18. The force F is controlled by means of a control unit, for example.

Figure 5:
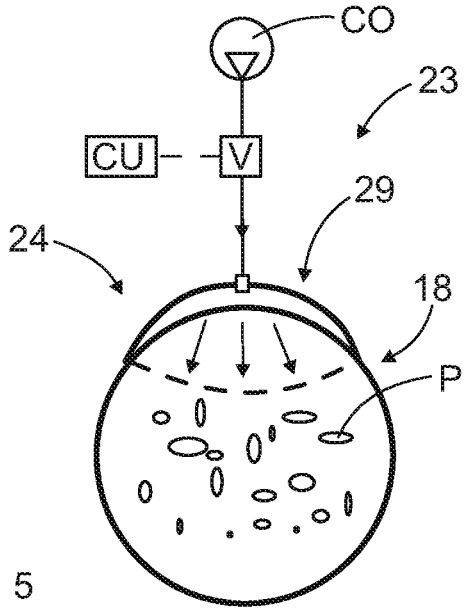

FIG. 5 discloses a basic principle of an expandable element 29, which is connectable to a pressure circuit, in this example, to a pneumatic circuit, wherein a compressor CO generates pressurized air and wherein a valve V and a control unit CU can control operation of the expandable element 29. Arrows indicate expansion of the expandable element 29. The expandable element 29 serves as a homogenizing element 24 and it may be either integrated as a part of the inlet tube 23, or it may be a separate element mounted on an inner surface of the inlet tube 23, for example.

It may also be possible to cause the deformation of the wall of the inlet tube 23 by means of an expandable element arranged on an outer surface of the inlet tube 18.

Figure 6:
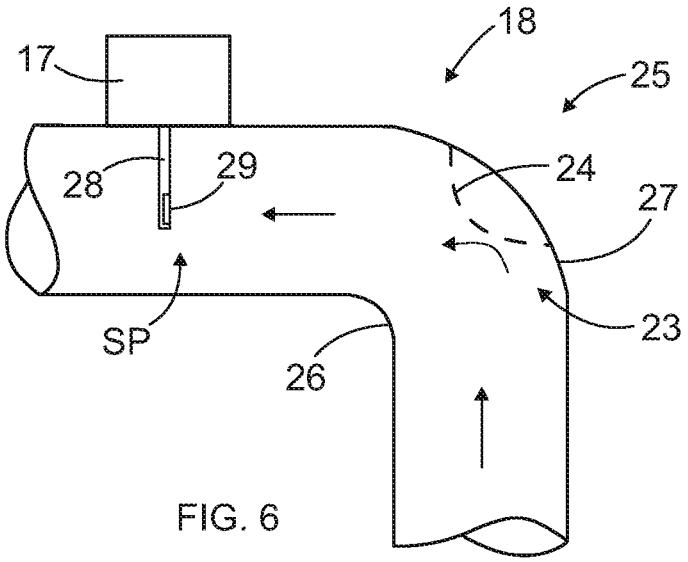
FIG. 6 is a schematic side view of a curved inlet tube provided with a controllable bulge at its outer curve.

FIG. 6 discloses an inlet tube 18 provided with a bend 25 having an inner curve 26 and an outer curve 27. A homogenizing section 23 is located at the bend 25 and an actively controllable dynamic homogenizing element 24 is located on a side of the outer curve 27. Spreading of solid particles of flow occurs prior reaching a sampling point SP where a sampling device 17 is located. The sampling device 17 may include a tube or sampling pipe 28 which is partly insertable inside the flow channel, and which is provided with an opening 29 through which material to be collected passes during the sampling. The samples taken can be stored in receptacles or bags, for example.

Figure 7:
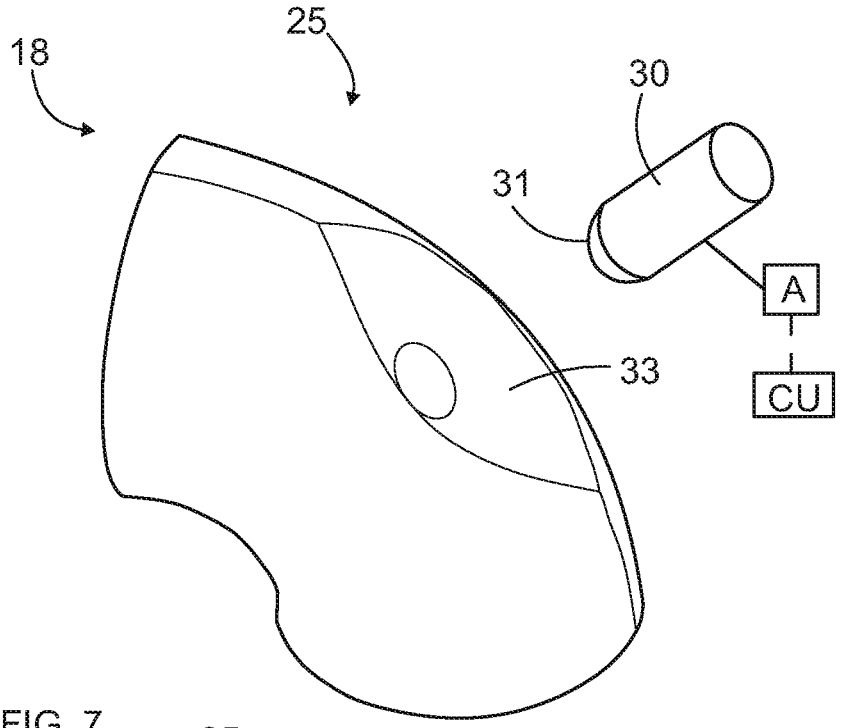
FIGS. 7 and 8 are schematic views showing deformation of an inlet tube by means of longitudinal movement of a rod.
Figure 8:
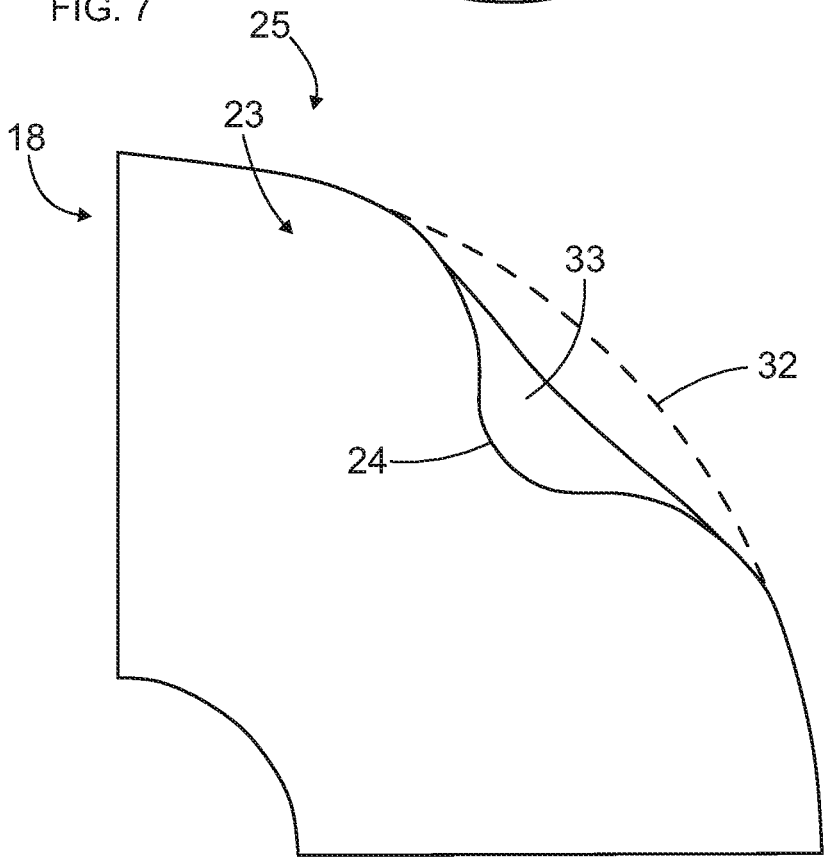

FIG. 7 discloses that an inlet tube 18 may be made of resilient material and can be reversible deformed by pushing its outer surface by means of a plunger or pushing element 30 provided with a rounded end 31. Then the deformed wall structure of the inlet tube 18 forms a homogenizing element 24, i.e., a bulge inside a homogenizing section 23, as it is shown in FIG. 8. The pushing element 30 may be moved by means of an actuator A, which may be controlled by a control unit CU, for example. FIGS. 7 and 8 show that original outer surface 32 is pushed inwards and a dent 33 is formed. The disclosed arrangement may be arranged at an outer curve of a bend 25.

Figure 9:
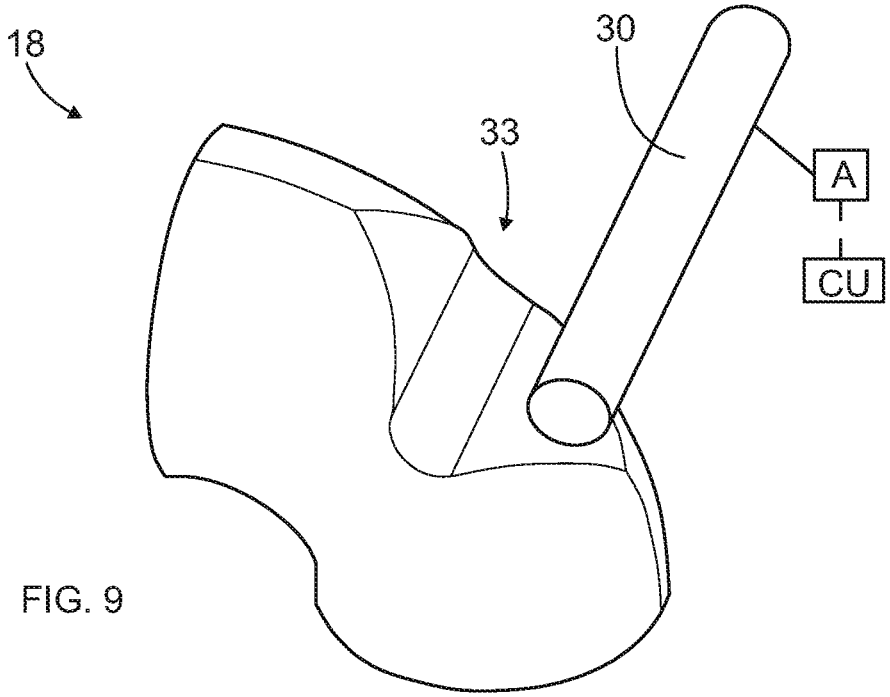
FIGS. 9 and 10 are schematic views showing deformation of an inlet tube by means of an outer circumference of a round rod.
Figure 10:
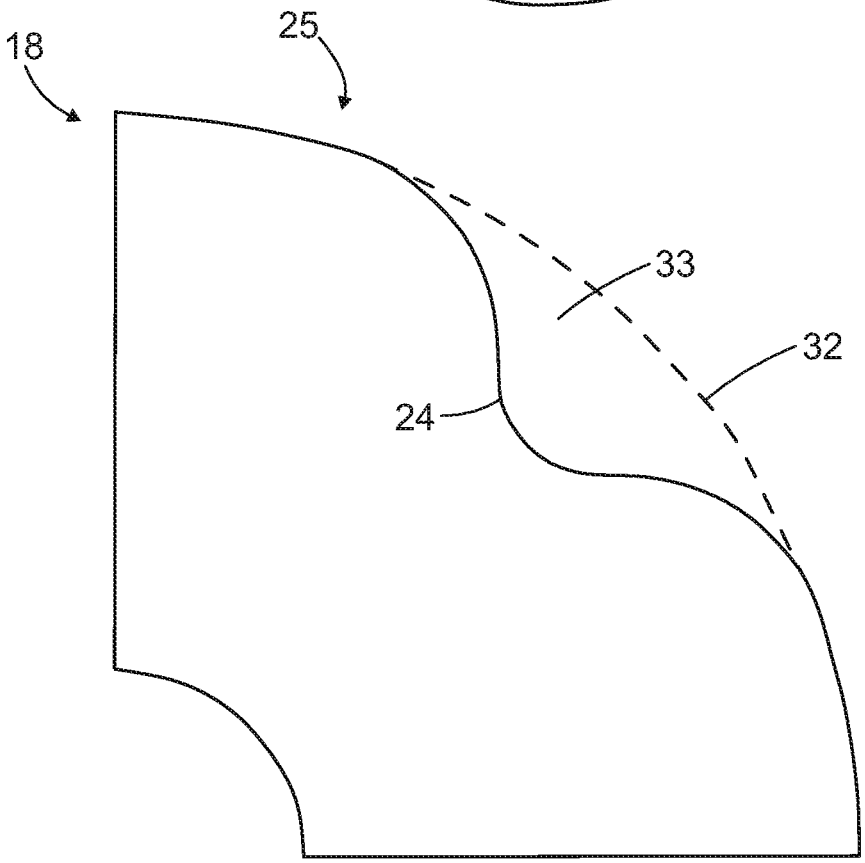

FIGS. 9 and 10 disclose an alternative solution, which differs from the one shown in FIGS. 7 and 8 in that different pushing element 30 is used. Further, in FIGS. 7 and 8 the pushing element 30 is moved in the longitudinal direction towards the outer surface of the inlet tube 18, whereas in FIGS. 9 and 10 an outer surface of the pushing element 30 is pressed against the inlet tube 18. Thereby, in these two alternative solutions, differently shaped deformations and homogenizing element 24 are formed. The shapes and dimensions of the formed homogenizing elements 24 can be adjusted by movement length of the pushing element 30 as well as by dimensions and shapes of the pushing elements.

Although the present embodiments have been described in relation to particular aspects thereof, many other variations and modifications and other uses will become apparent to those skilled in the art. It is preferred therefore, that the present embodiments be limited not by the specific disclosure herein, but only by the appended claims.

The invention claimed is:

1. An inlet tube of and a sample taking arrangement of a rock drilling rig, the inlet tube being configured to direct a flow of drilling cuttings and air to a sampling point, the inlet tube comprising:

a cross-sectional inner shape and dimensions; and a homogenizing section, wherein an inner cross-section of the inlet tube includes at least one homogenizing element forming a physical point of discontinuity, wherein shape and dimensions of the inner cross-section differ locally from sections prior and after the homogenizing section and which homogenizing element is configured to generate a disturbance in the flow and to thereby homogenize particle distribution of the drilling cuttings in the flow at the section after the homogenizing section and prior to the sampling point, wherein the homogenizing element is an active controllable element providing the homogenizing section selectively with the physical point of discontinuity, wherein the homogenizing element is a selectively expandable element.

2. The inlet tube and sampling arrangement as claimed in claim 1, wherein the inlet tube includes a bend and the homogenizing section is located at the bend.

3. The inlet tube and sampling arrangement as claimed in claim 1, wherein the inlet tube is made of resilient material and includes at least one actuator at the homogenizing section for directing an external force on an outer surface side of the inlet tube for selectively causing reversible deformation of the structure of the inlet tube at the homogenizing section so that material of a wall of the inlet tube protrudes inwards providing the inlet tube with an inner bulge which serves as the homogenizing element.

4. A rock drilling rig comprising:

a movable carrier;

at least one drilling boom mounted on the carrier and including a rock drilling unit provided with a rock drilling machine;

a dust collecting system arranged for removing drilling cuttings from an opening of a drilled hole, wherein the dust collecting system is provided with a suction unit, dust collecting tubing, and at least one separator for separating solid particles from flow containing air and the drilling cuttings;

at least one sampling point for taking samples of the flow, wherein the sampling point is located prior to the separator so that the flow is still unseparated at the sampling point; and an inlet tube, the inlet tube being configured to direct a flow of the drilling cuttings and air to the at least one sampling point, the inlet tube having a cross-sectional inner shape and dimensions, and a homogenizing section, wherein an inner cross-section of the inlet tube includes at least one actively controllable homogenizing element in the dust collecting system preceding the sampling point, the homogenizing element forming a physical point of discontinuity, wherein shape and dimensions of the inner cross-section differ locally from sections prior and after the homogenizing section and which homogenizing element is configured to generate a disturbance in the flow and to thereby homogenize particle distribution of the drilling cuttings in the flow at the section after the homogenizing section and prior to the sampling point, wherein the homogenizing element is an active controllable element providing the homogenizing section selectively with the physical point of discontinuity.

5. A method of sampling in a rock drilling rig, the method comprising:

drilling drill holes in a rock surface;

collecting produced drilling cuttings from an opening of the drill holes during the drilling by a dust collecting system;

taking samples of flow containing air and drilling cuttings at a sampling point of the dust collecting system during the drilling;

providing the dust collecting system with an inlet tube before the sampling point; and changing actively a cross-sectional inner shape and dimensions of the inlet tube locally for spreading drilling cutting particles in the flow evenly across the inner cross-section of the inlet tube, whereby the samples are taken downstream of the mentioned particle spreading.

6. The method as claimed in claim 5, further comprising pressing transversally a reversible deform deformation to a resilient wall structure of the inlet tube at the homogenizing section for changing the cross-sectional inner shape and dimensions of the inlet tube locally by means of an inner bulge formed in response of the pressing.

7. The method as claimed in claim 6, further comprising controlling the change of the cross-sectional inner shape and dimensions of the inlet tube under control of a control unit.

* * * * *